US008176661B2

(12) United States Patent
Brame

(10) Patent No.: US 8,176,661 B2
(45) Date of Patent: May 15, 2012

(54) PLOW DEVICE AND METHOD

(76) Inventor: Gregory Brame, Westerville, OH (US)

( * ) Notice: Subject to any disclaimer, the term of this patent is extended or adjusted under 35 U.S.C. 154(b) by 0 days.

(21) Appl. No.: 13/087,402

(22) Filed: Apr. 15, 2011

(65) Prior Publication Data

US 2012/0090202 A1 Apr. 19, 2012

Related U.S. Application Data

(63) Continuation of application No. 12/641,143, filed on Dec. 17, 2009, now abandoned.

(60) Provisional application No. 61/201,971, filed on Dec. 17, 2008.

(51) Int. Cl.
*E02F 3/76* (2006.01)

(52) U.S. Cl. ..... 37/266

(58) Field of Classification Search ..... 37/231–236, 37/263, 266, 270; 172/810–817
See application file for complete search history.

(56) References Cited

U.S. PATENT DOCUMENTS

| | | | |
|---|---|---|---|
| 1,392,166 | A | 9/1921 | Immer |
| 2,218,512 | A | 10/1940 | Ball |
| 2,223,993 | A | 12/1940 | Jessup |
| 2,488,695 | A | 11/1949 | Upton |
| 3,087,266 | A | 4/1963 | McEvoy |
| 3,608,216 | A | 9/1971 | Prescott |
| 3,760,516 | A | 9/1973 | Billingsley |
| 3,807,065 | A | 4/1974 | Billingsley |
| 4,024,653 | A | 5/1977 | Morris |
| 4,073,077 | A | 2/1978 | Essel et al. |
| 4,074,448 | A | 2/1978 | Niemela |
| 4,304,056 | A | 12/1981 | Watson et al. |
| 4,665,636 | A | 5/1987 | Borras |
| 4,754,562 | A | 7/1988 | McGarrah et al. |
| 4,776,115 | A | 10/1988 | Nicodemus et al. |
| 4,873,775 | A | 10/1989 | Richey |
| 4,944,104 | A | 7/1990 | Kowalczyk |
| 5,094,019 | A | 3/1992 | DeVincenzo |
| 5,251,390 | A | 10/1993 | Wong |
| 5,509,219 | A | 4/1996 | Mecca |
| 5,560,129 | A | 10/1996 | Rothbart |
| 5,647,153 | A | 7/1997 | Gervais |
| 6,240,658 | B1 | 6/2001 | Knutson et al. |
| 6,269,557 | B1 | 8/2001 | Henks |
| 6,516,544 | B1 | 2/2003 | Matisz et al. |
| 2007/0089327 | A1 | 4/2007 | Watson |

FOREIGN PATENT DOCUMENTS

| | | |
|---|---|---|
| WO | WO 96/41056 A1 | 12/1996 |

OTHER PUBLICATIONS

Knutson, Greg, Kar-plow Web Site, Dec. 16, 2009, http://www.marketlaunchers.com/knutson.html.

*Primary Examiner* — Robert Pezzuto
(74) *Attorney, Agent, or Firm* — Lech Law, LLC; Robert R. Lech

(57) ABSTRACT

A plow device is disclosed. The plow device comprises a blade and a plurality of struts attached to the blade. Each strut comprises an arm comprising a first end and a second end. Each arm is attached to the blade at its first end. Each strut further comprising a tire wedge disposed at the second end of the arm.

20 Claims, 5 Drawing Sheets

PLOW DEVICE AND METHOD

CROSS-REFERENCE TO RELATED APPLICATIONS

This application claims priority to U.S. Provisional Patent Application Ser. No. 61/201,971 filed Dec. 17, 2008 and U.S. Non-Provisional application Ser. No. 11/641,143 entitled "Plow Device and Method" filed Dec. 17, 2009, which are incorporated by reference in its entirety as if fully set forth herein.

TECHNICAL FIELD

The present application generally relates to devices and methods for plowing material. More specifically, the present application relates to plow devices which may be pushed by a vehicle.

BACKGROUND

Motorized plows are well known in the art. Some motorized plows are specialized vehicles designed specifically for plowing while others are merely heavy duty vehicles with plow equipment installed thereon.

Property owners occasionally have a need to plow material along driveways and/or parking areas. The material may be snow, dirt, gravel, mulch or other similar material. For example, homeowners in the Midwest may need to plow snow from their driveways several times during a winter. Because their plowing needs may be sporadic, few property owners dedicate their resources to obtaining a specialized plow vehicle or a heavy duty vehicle which can accommodate attached plowing equipment.

Accordingly, there is a need for a plow that may be used with a variety of conventional automobiles. Specifically, a need exists for an easy to use snow plow specifically geared toward homeowners with driveways and a conventional vehicle. There is further a need for a plow which is not attached to a vehicle.

SUMMARY

According to a first aspect of the present application, a first example plow device is disclosed. The first example plow device comprises: a blade and a plurality of struts attached to the blade. Each strut comprises an arm comprising a first end and a second end. Each arm being attached to the blade at its first end. Each strut further comprising a tire wedge disposed at the second end of the arm.

According to a second aspect of the present application, a second example plow device is disclosed. The second example plow device comprises: an adjustable blade and a plurality of struts attached to the blade. The blade comprises a plurality of sections which are movable with respect to one another, thereby enabling adjustment of the blade width. Each strut comprises an arm comprising a first end and a second end. Each arm being attached to the blade at its first end. Each strut further comprising a tire wedge disposed at the second end of the arm. Each tire wedge comprising a flange.

According to a third aspect of the present application, a method for plowing material is disclosed. The method comprises configuring a plow device to engage a tire of a vehicle. The plow device comprises a blade and a tire wedge. The method further comprises engaging the tire wedge of the plow with the tire of the vehicle.

BRIEF DESCRIPTION OF THE DRAWINGS

The accompanying figures, which are incorporated in and constitute a part of the specification, illustrate various example apparatuses, systems, methods, and so on, and are used merely to illustrate various example embodiments. It should be noted that various components depicted in the figures may not be drawn to scale, and that the various assemblies and designs depicted in the figures are presented for purposes of illustration only, and should not be considered in any way as limiting.

DETAILED DESCRIPTION

Figure 1:
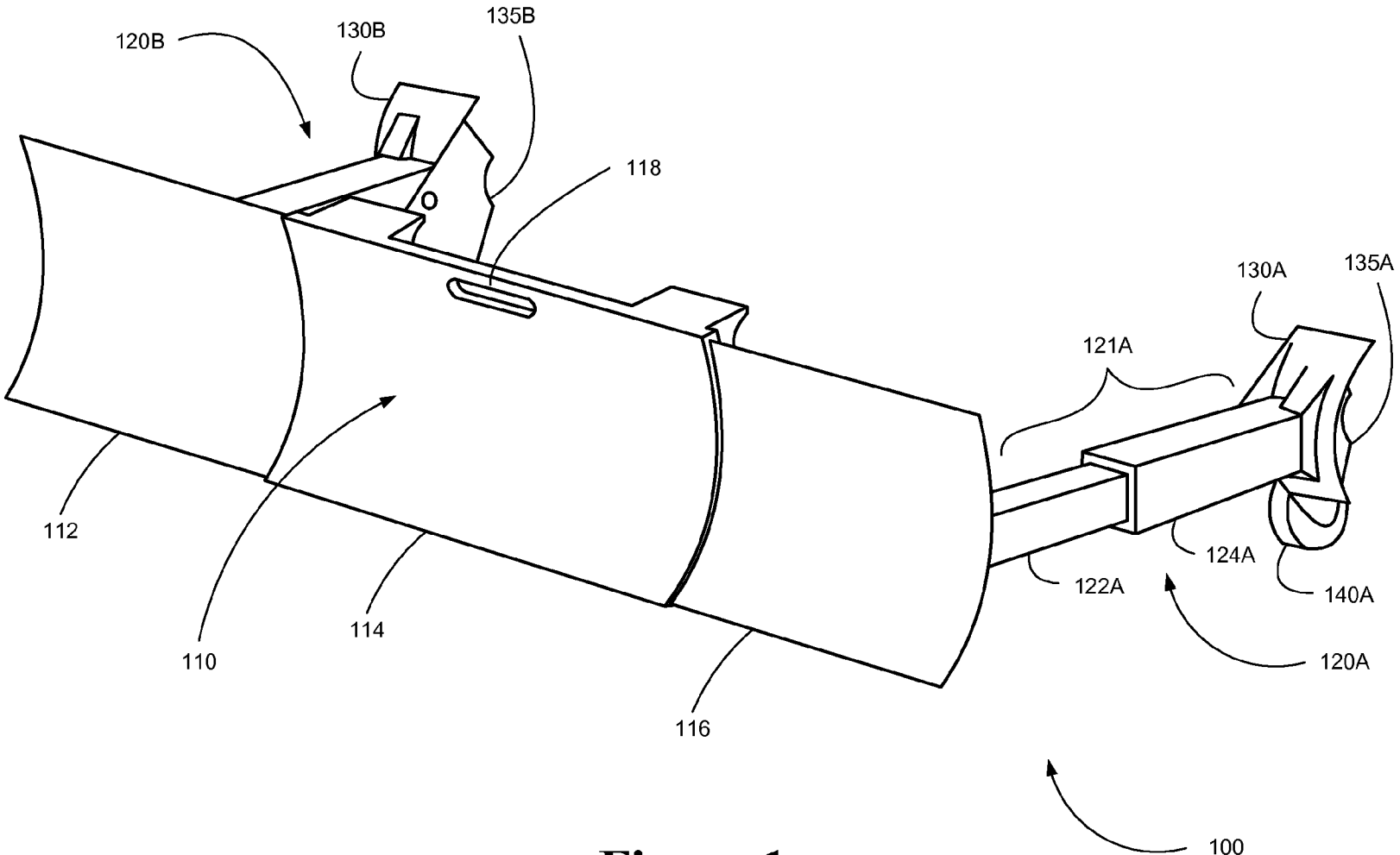
FIG. 1 illustrates a perspective front view of a first example plow device.
Figure 2:
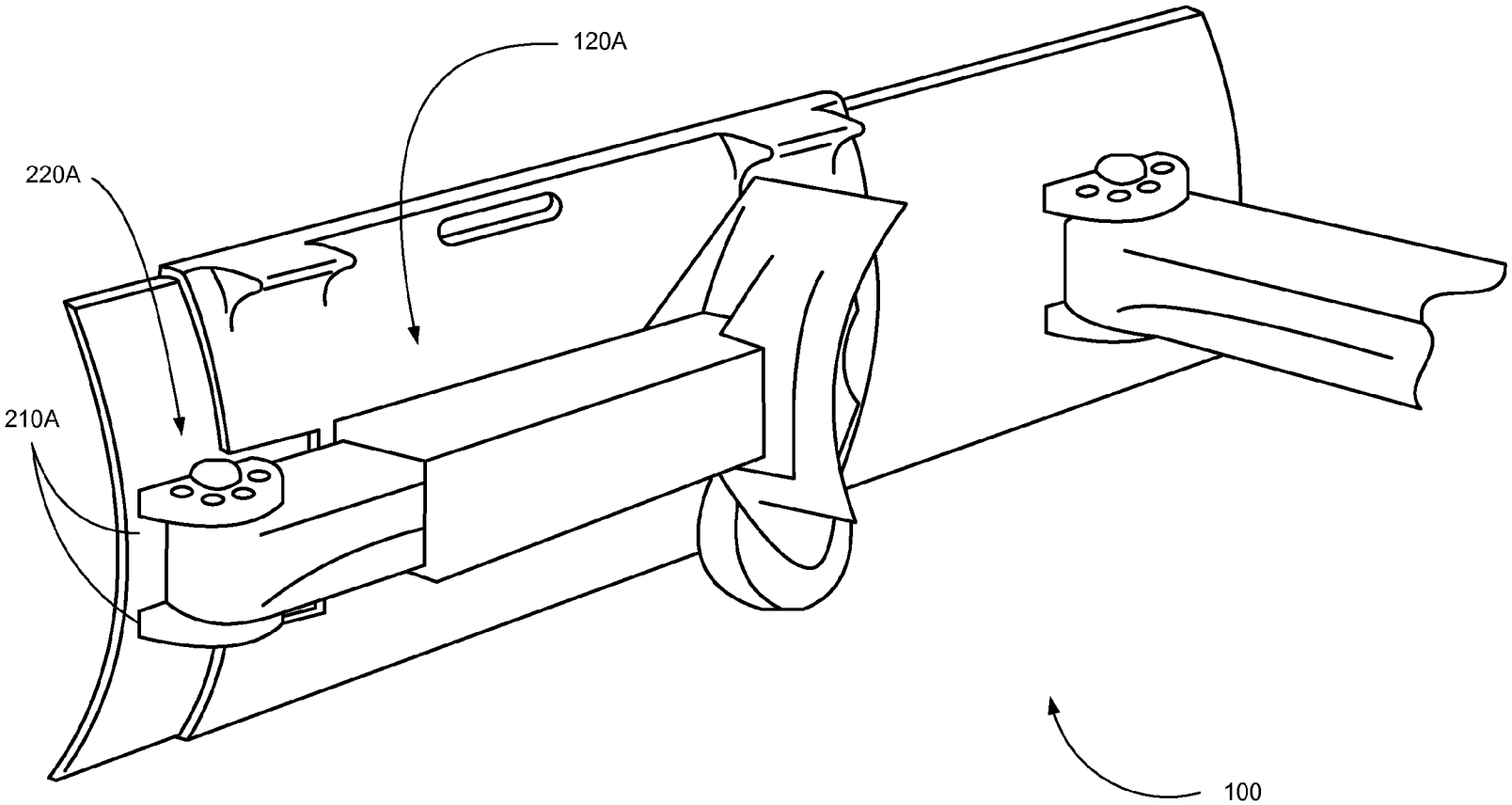
FIG. 2 illustrates a perspective rear view of the first example plow device.

FIGS. 1 and 2 illustrate a first example plow device 100. FIG. 1 is a perspective front view of first example device 100. FIG. 2 is a perspective rear view of first example device 100.

As shown, device 100 comprises a blade 110 for plowing material. Example blade 110 comprises three sections 112, 114 and 116. Sections 112, 114 and 116 may be adjustable with respect to each other such that the width of blade 110 may be collapsed or extended. In alternate embodiments, blade 110 may comprise a single section or selected sections of the blade 110 may be curved or angled, for example to form a U or V shape. Example blade 110 further comprises an optional handle to accommodate configuring and manually moving device 100.

Example plow device 100 further comprises two struts 120A and 120B. Blade 110 and struts 120A and 120B may be constructed from plastic or any appropriate metal or composite. For simplicity, strut 120A will be described in detail herein, but it should be appreciated that strut 120B comprises elements which correspond to like elements of strut 120A.

Strut 120A comprises an arm 121A formed by telescoping elements 122A and 124A which are moveable with respect to each other to enable lengthening and/or shortening of arm 121A. When plow device 100 is stored, telescoping elements 122A and 124A may be fully collapsed to produce a small storage footprint. It should be appreciated that in an alternate embodiment arm 121A may comprise a single, non-adjustable element. It should be further appreciated that while the illustrated adjustment mechanism comprises telescoping elements 122A and 124A, any other length adjustment mechanism known in the art are envisioned.

Strut 120A is attached to blade 110 at a first end of arm 121A, and a second end of arm 121A is attached to a tire wedge 130A. It should be appreciated that while arm 121A is illustrated as directly attached to blade 110, in alternate embodiments, such attachment may be indirect, using a bracket for example. Tire wedges 130A and 130B are positioned to rest against front or rear tires of a vehicle (not shown). Although tire wedges 130A and 130B are illustrated as having a curvature that accommodates the curvature of a tire, the tire wedges may be designed to have flat surfaces in other embodiments. Further, although not illustrated, the tire wedges may be designed to be adjustable, thereby accommodating various tire sizes.

When a drive mechanism of the vehicle is engaged, the vehicle tires engage and cooperate with tire wedges 130A and 130B. The tires apply force to tire wedges 130A and 130B, and the force is absorbed by struts 120A and 120B. Accordingly, the force is transferred to blade 110 and plow device 100 is urged forward thereby plowing material in front of plow device 100. Likewise, when plowing material, tire wedges 130A and 130B are pushed into and distribute the load to the tires.

Tire wedges 130A and 130B may be manufactured from steel, plastic, aluminum or other similar material including composites, and they may be adjustable to accommodate various tire sizes. Tire wedges 130A and 130B may each comprise one or more flanges, such as flange 135A. Although flange 135A is illustrated as disposed on an inside edge of tire wedge 130A, in other embodiments, tire wedge 130A may comprise a flange on an outside edge of tire wedge 130A, or on both the inside and outside edges of tire wedge 130A.

Flanges 135A and 135B cooperate with the side walls of cooperating tires and prevent lateral or vertical movement or slippage of plow device 100 as the vehicle moves and device 100 displaces the snow or other material.

Like tire wedge 130A, a wheel 140A is disposed at the second end of arm 121A. Wheel 140A operates to support the second end of arm 121A. Wheel 140A may further operate to properly position tire wedge 130A with respect to a cooperating tire. Of course, the size and location of wheel 121A may be varied in accordance with design considerations in alternate embodiments of plow device 100. Alternate embodiments may not employ the wheels, or the other mechanisms may be substituted for the wheels, such as skis or skids.

As illustrated in FIG. 2, blade 110 may form strut receptacle 210A. The illustrated strut receptacle 210A forms a hinge that permits strut 120A to be configured at various angles with respect to blade 110. For example, strut 120A may be folded substantially parallel with blade 110 for compact storage. Strut 120A may also be configured, for example, at a 45 degree angle to blade 110 to plow material predominantly to one side of the vehicle.

The illustrated hinge includes a locking mechanism 220A for securing strut 120A into position relative to blade 110. While the illustrated locking mechanism comprises a pin and various receiving apertures, other mechanisms for securing strut 120A are contemplated.

Figure 3:
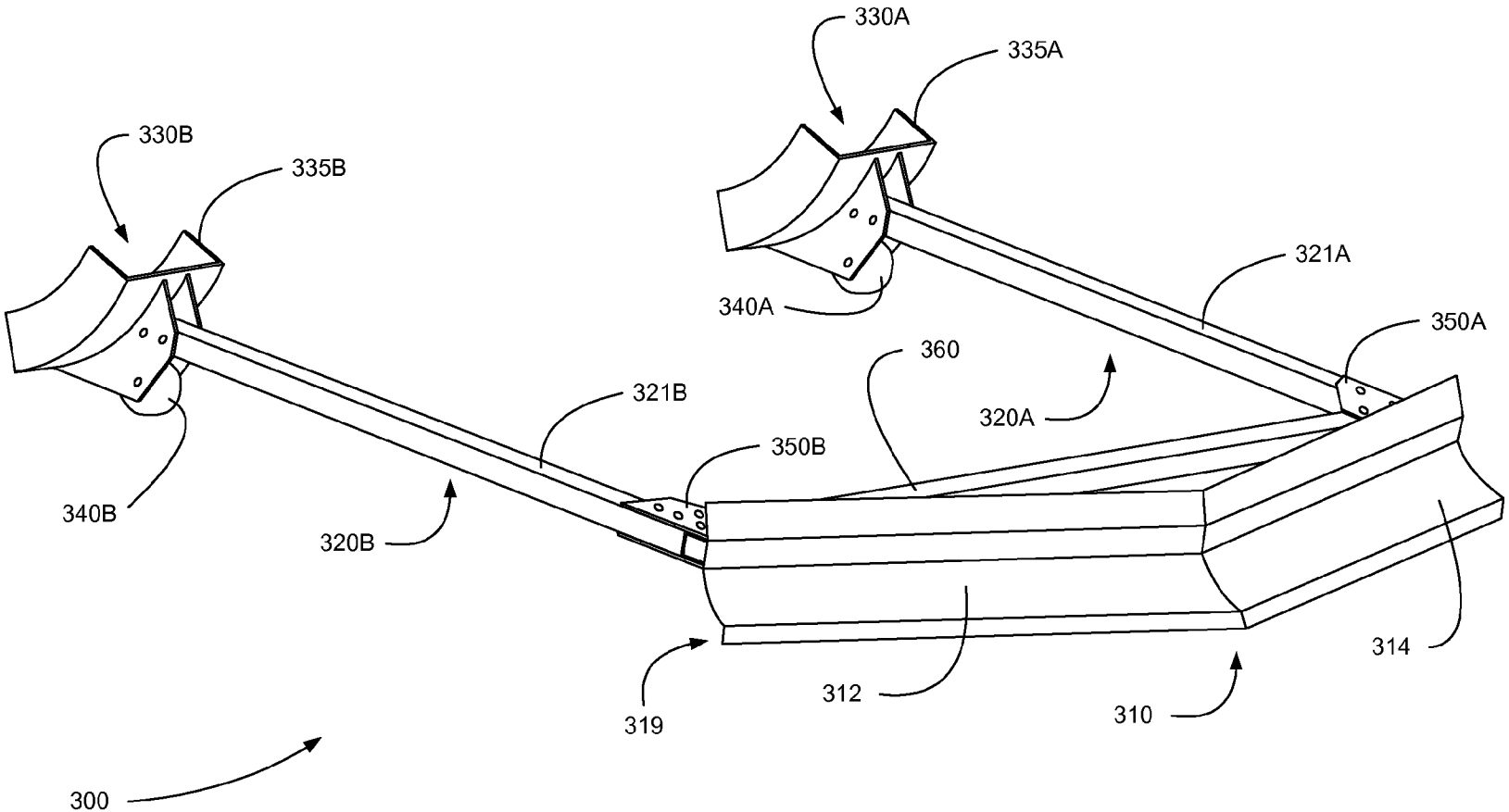
FIG. 3 illustrates a perspective front view of a second example plow device.
Figure 4:
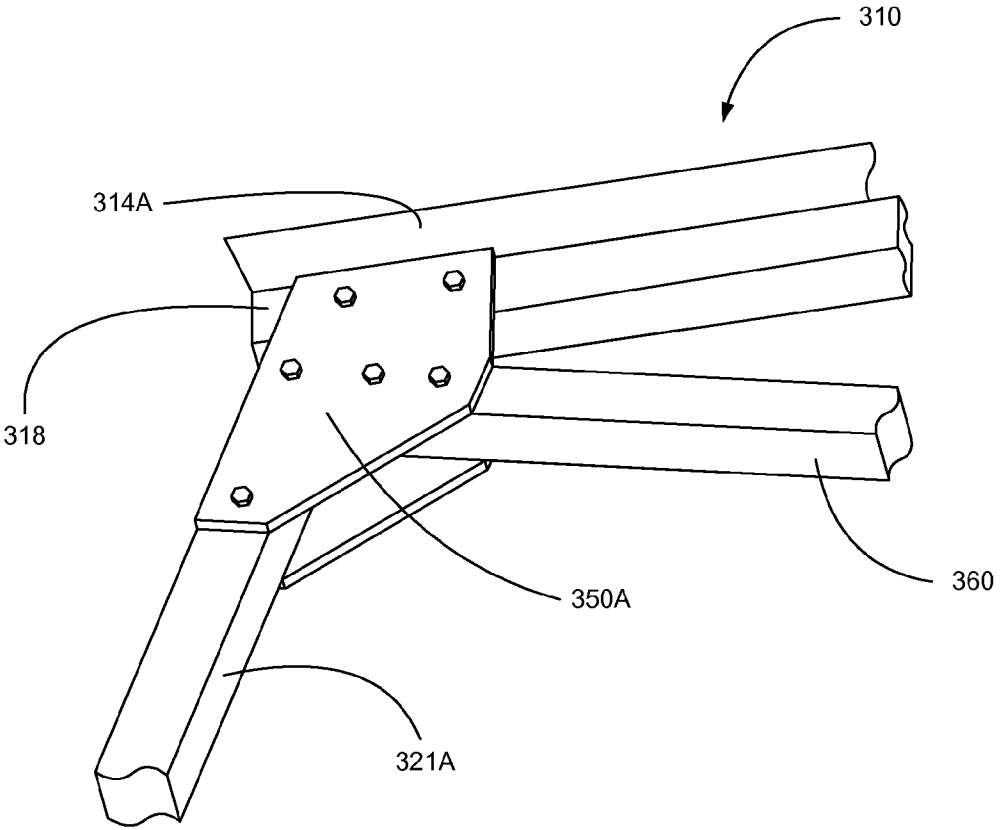
FIG. 4 illustrates a magnified view of a strut receptacle of the second example plow device.
Figure 5:
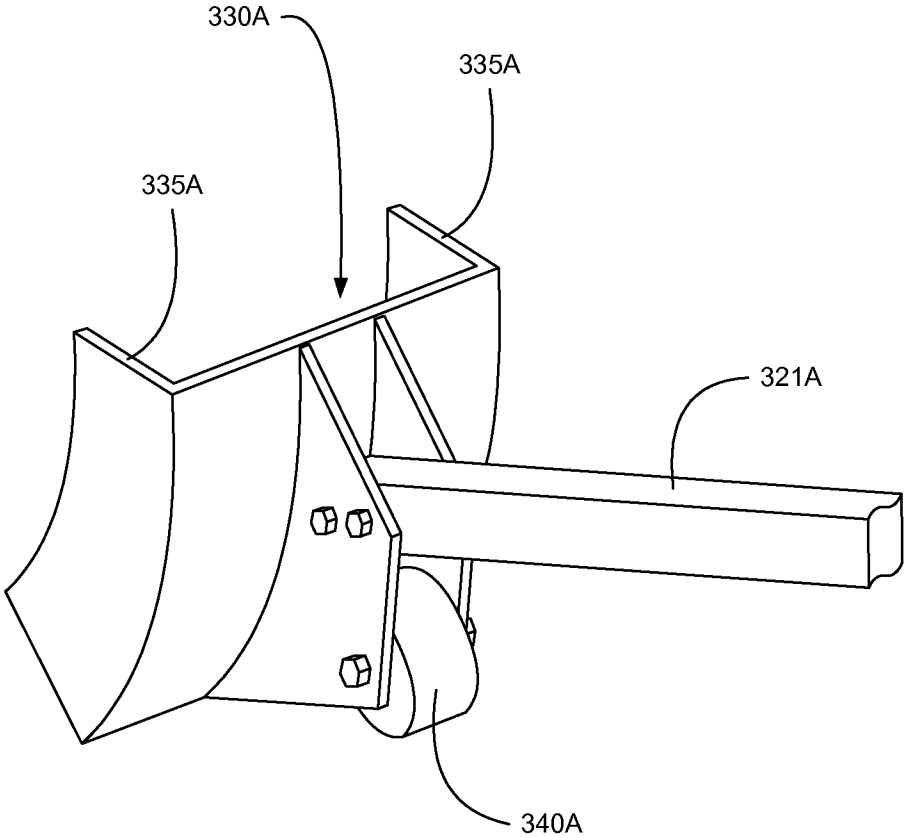
FIG. 5 illustrates a magnified view of a tire wedge of the second example plow device.

Referring now to FIGS. 3-5, there is illustrated a second example plow device 300. Device 300 is designed to be a lightweight embodiment with a small storage footprint. Device 300 comprises a blade 310 with sections 312 and 314. Blade 310 further comprises a support bar 318 which may provide structural support for blade 310. Support bar 318 may further provide convenient attachment point for other elements, such as strut receptacles 350A and 350B.

As illustrated, blade 310 may be V-shaped, and may comprise a hinge (not shown) at the center of blade 310, between sections 312 and 314, to enable blade 310 to be folded for storage. In alternative embodiments, blade 310 may be U-shaped or shaped in any manner conducive to plowing.

Blade 310 further comprises a lower lip 319. Lip 319 is designed to prevent blade 310 from catching on any cracks, defects of inconsistencies in the surface from which material is to be plowed. Lip 319 may be a different material from the rest of blade 310, such as rubber or plastic, to absorb the shock of passing over any surface deformities. Further, the lower edge of lip 319 may be set back from the upper edge, thereby angling the lip away from the direction of travel when plowing to further improve performance.

Device 300 further comprises two struts 320A and 320B which are attached to blade 310 by strut receptacles 350A and 350B, respectively. Struts 320A and 320B comprise arms 321A and 321B, tire wedges 330A and 330B, flanges 335A and 335B and wheels 340A and 340B, respectively.

Although strut receptacles 350A and 350B are illustrated as fixed, they may be movably attached to blade 310 to enable struts 320A and 320B to slide toward the center of blade 310 for storage. For example, instead of using bolts to fasten the strut receptacles to the blade, removable pins may be used. Strut receptacles 350A and 350B may be hinged to enable struts 320A and 320B to remain substantially parallel in the event that blade 310 is folded for storage. In an alternate embodiment, strut receptacles 350A and 350B may be hinged to enable struts 320A and 320B to fold around to the front of blade 310 for compact storage.

As illustrated, device 300 may further comprise a horizontal support member 360 to provide structural integrity to device 300. Although not shown in the drawing figures, device 300 may also include a tow-back mechanism to enable device 300 to be pulled back by the vehicle at the conclusion of a plowing run. One example tow-back mechanism may be a strap that is attached to device 300 at one end and attached to the vehicle at the other end. Such a strap may be attached to device 300 at a bracket or handle installed in the center of support member 360, and it may be attached to the vehicle at a hitch or by closing an end of the strap in the trunk of the vehicle.

In an alternate embodiment, device 300 may comprise a tow-back mechanism embodied as a tow-back arm attached to the outside edge of a tire wedge. The arm may extend along the outside tire wall to the side of the tire opposite the tire wedge. The arm may comprise a finger or other mechanism that catches and cooperates with the side of the tire opposite the tire wedge to enable the device to be pulled back after a towing run.

In order to use the plow devices described herein, a user of the plow extends to a desired width. The user may then configure the struts attached to the blade by unfolding the struts at the attached hinges, locking the struts into place, and extending or collapsing the struts to extend the desired to the desired length. The user then positions the plow device at one end of a vehicle so that the tire wedges fit snugly against the tires and that the flanges are snugly riding on the inside and/or outside tire walls. Of course, these steps can be done in an interchangeable fashion depending upon user preference.

The user may then engage the vehicle to move in a forward or backward direction to engage the plow depending on whether the plow is placed in front of the vehicle or behind the vehicle. The loads and forces resulting from pushing material, such as snow, are transferred from the blade of the device through the struts to the tire wedges and ultimately to the tires. As the material is pushed by the plow blade, the material is displaced to either side of the vehicle.

The plow devices described herein are engaged by the tires of a vehicle. One advantage of such plow devices is the ability of a user to plow material using a conventional vehicle. A further advantage of the described plow devices is that they may be used without being physically attached or installed onto the vehicle.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A plow device comprising:

a blade; and a plurality of struts attached to the blade, each strut comprising:

an arm comprising a first end and a second end, the arm being attached to the blade at the first end, and a tire wedge disposed at the second end of the arm, the tire wedge comprising a contiguous, non-convex tire receiving surface, the tire wedge being entirely elevated above a ground level during operation.

2. The plow device of claim 1 wherein the blade comprises a plurality of sections, the sections being movable with respect to one another.

3. The plow device of claim 1 further comprising a strut hinge, the strut hinge being formed by the blade and the arm of the strut.

4. The plow device of claim 1 wherein each arm comprises a plurality of telescoping sections.

5. The plow device of claim 1 wherein the tire wedge comprises a flange.

6. The plow device of claim 1 wherein the tire wedge comprises an inner edge, and the tire wedge further comprises a flange in proximity to the inner edge.

7. The plow device of claim 1 further comprising a plurality of wheels, each wheel being associated with one of the plurality of arms, and each wheel disposed at the second end of the associated arm.

8. The plow device of claim 1 further comprising a handle.

9. A plow device comprising:

an adjustable blade, the blade comprising a plurality of sections, the sections being movable with respect to one another, thereby adjusting a width of the blade; and a plurality of struts attached to the blade, each strut comprising:

an arm comprising a first end and a second end, the arm being attached to the blade at the first end, and a tire wedge disposed at the second end of the arm, the tire wedge being entirely elevated above a ground level during operation, the tire wedge comprising a contiguous, non-convex tire receiving surface and a flange.

10. The plow device of claim 9 further comprising a strut hinge, the strut hinge being formed by the blade and the arm of the strut.

11. The plow device of claim 9 wherein each arm comprises a plurality of telescoping sections.

12. The plow device of claim 9 wherein the tire wedge comprises an inner edge, and the tire wedge further comprises a flange in proximity to the inner edge.

13. The plow device of claim 9 further comprising a plurality of wheels, each wheel being associated with one of the plurality of arms, and each wheel disposed at the second end of the associated arm.

14. The plow device of claim 9 further comprising a handle.

15. A method for plowing material comprising:

positioning a plow device, the plow device comprising a blade and a tire wedge, the tire wedge comprising a contiguous, non-convex tire receiving surface, the tire wedge being entirely elevated above a ground level during operation, the positioning comprising aligning the tire wedge with a tire of a vehicle; and engaging the tire wedge of the plow with the tire of the vehicle.

16. The method of claim 15 wherein the configuring comprises adjusting the blade.

17. The method of claim 15 wherein the configuring comprises adjusting a strut of the plow device.

18. The method of claim 15 wherein the configuring comprises positioning the tire wedge in proximity to the tire.

19. The method of claim 15 wherein the configuring comprises adjusting the width of the tire wedge to match the width of the tire.

20. The method of claim 15 further comprising driving the tire wedge engaged with the tire, thereby moving the vehicle in a direction of the plow device.

* * * * *